US006494126B1

(12) United States Patent
Leinonen

(10) Patent No.: US 6,494,126 B1
(45) Date of Patent: Dec. 17, 2002

(54) RADIAL PISTON HYDRAULIC MOTOR

(75) Inventor: Mauno Leinonen, Jyväskylä (FI)

(73) Assignee: Valmet Hydraulics Oy, Jyvaskyla (FI)

( * ) Notice: Subject to any disclaimer, the term of this patent is extended or adjusted under 35 U.S.C. 154(b) by 0 days.

(21) Appl. No.: 09/554,339

(22) PCT Filed: Nov. 9, 1998

(86) PCT No.: PCT/FI98/00868

§ 371 (c)(1),
(2), (4) Date: Aug. 1, 2000

(87) PCT Pub. No.: WO99/24711

PCT Pub. Date: May 20, 1999

(30) Foreign Application Priority Data

Nov. 11, 1997 (FI) ..... 974195

(51) Int. Cl.[7] ..... F04B 39/10

(52) U.S. Cl. ..... 91/491; 91/496; 91/498; 417/273

(58) Field of Search ..... 91/491, 496, 498; 417/273

(56) References Cited

U.S. PATENT DOCUMENTS 4,356,761 A 11/1982 Cameron-Johnson et al.
5,115,890 A * 5/1992 Noel ..... 91/491
5,186,094 A * 2/1993 Allart ..... 91/491
5,261,318 A * 11/1993 Allart ..... 91/491
5,558,003 A * 9/1996 Bauzou et al. ..... 417/273
5,664,476 A * 9/1997 Lemaire et al. ..... 91/491
6,186,046 B1 * 1/2001 Allart et al. ..... 91/491

FOREIGN PATENT DOCUMENTS

EP 0651159 5/1993 ..... 91/491
GB 1300046 12/1972 ..... 91/491
GB 2261710 5/1995

* cited by examiner

*Primary Examiner*—Cheryl J. Tyler
(74) *Attorney, Agent, or Firm*—Steinberg & Raskin, P.C.

(57) ABSTRACT

The invention relates to a radial-piston hydraulic motor (10), having at least one cylinder groups (1) placed in a stationary position, which. cylinder groups contain piston mechanisms moving radially back and forth. A cam ring (12) is connected with a box frame (11) and the box frame with a distributor valve (13), which controls the pressurized fluid flow at the correct time into the cylinder spaces of the pistons that are at the power stage. The sense of rotation of the motor can be reversed by reversing the direction of flow of the fluid through the distributor valve (13). The fluid is passed to the distributor valve (13) through the sets of ducts in the shaft (14) which is placed in a stationary position together with the cylinder frame(s) (15) of at least one cylinder groups (1). The distributor (13) has a duct (31) which communicates with the power pressure and which is opened on the side face **(13*a*) of the distributor (13). In this connection the force is applied, through the fluid at the power pressure, to the side face (13*a*) of the distributor (13)**.

17 Claims, 5 Drawing Sheets

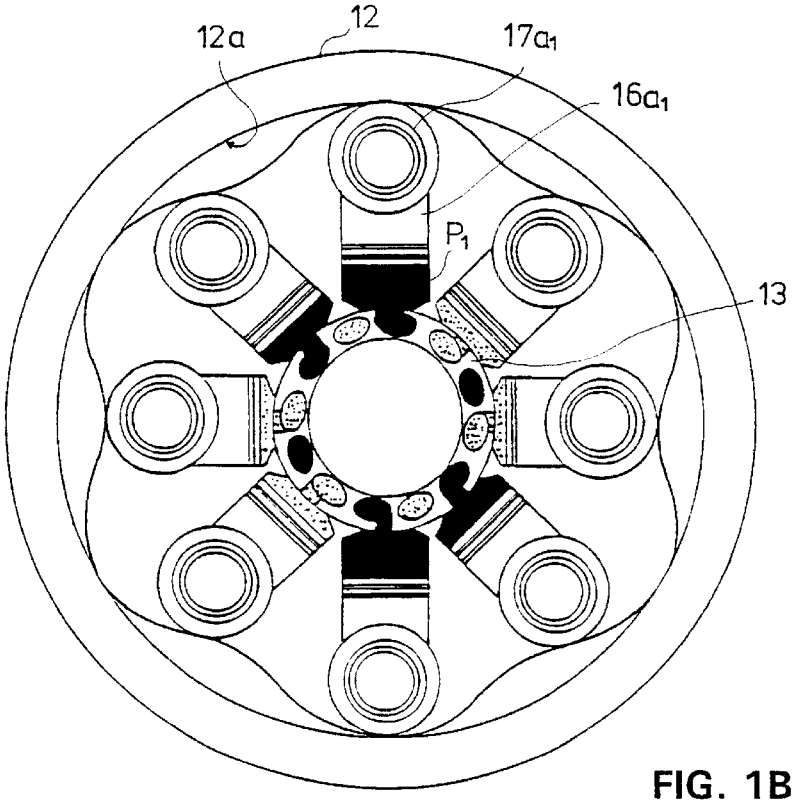
FIG. 1B
FIG. 2
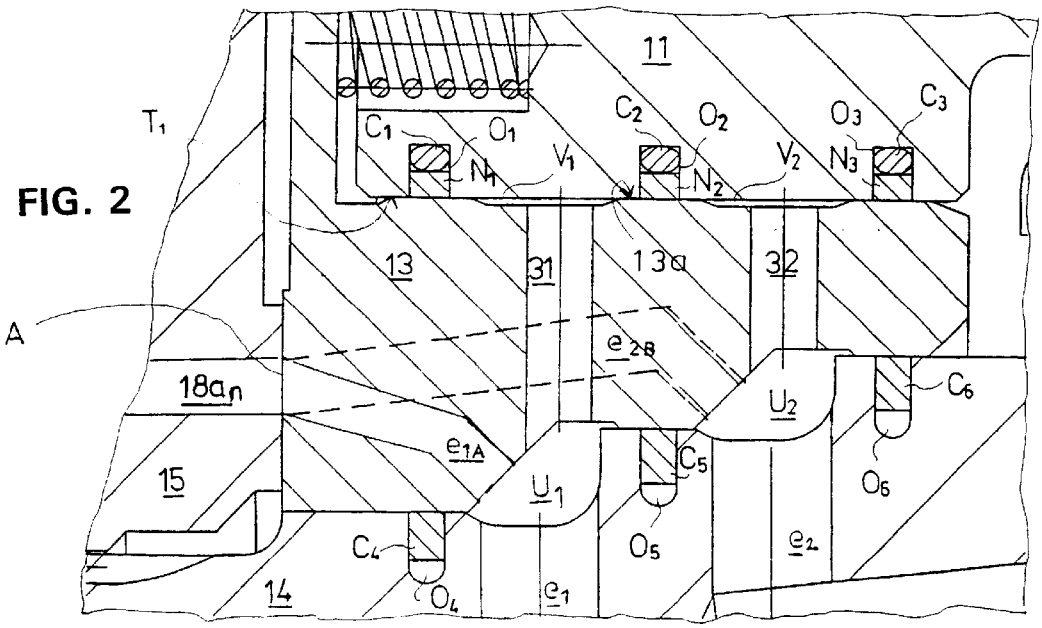

RADIAL PISTON HYDRAULIC MOTOR

FIELD OF THE INVENTION

The invention concerns a radial-piston hydraulic motor.

BACKGROUND OF THE INVENTION

From the prior art, solutions of radial-piston hydraulic motors are known in which a box frame is rotated and in which the box frame is connected with a distributor attached to the box frame. The distributor is a what is called distributor valve, which comprises bores placed parallel to the longitudinal axis of the distributor sleeve and opening on the front face of the distributor. Inlet ducts pass into the distributor, and outlet ducts pass out of the distributor. The inlet ducts open on the front face of the distributor, and so do the outlet ducts. The ducts at each particular time concerned in the distributor valve communicate alternatingly with pistons spaces, which piston spaces comprise pistons and press wheels connected with the pistons, said press wheels being fitted to move against a cam ring fitted in connection with the box frame. Thus, some of the pistons are in a power stage, and some are not. Pressurized medium is passed into the pistons that are at the power stage through the ducts in the distributor, and in a corresponding way, those pistons that have by-passed the power stage discharge fluid through the distributor through the outlet ducts in the distributor. The press wheels provided on the pistons press the cam ring provided on the box frame. The cam ring has a wave-formed shape, the cam ring and the connected box frame being rotated by means of the press wheels. In order that the distributor should operate as well as possible, the front face of the distributor must be in tight glide fitting against the front face of the cylinder frame, which cylinder frame comprises the ducts passing into the piston spaces.

In practice, it has been noticed that the pressurized fluid attempts to work/distort the distributor, and, thus, the contact on said front faces tends to deteriorate.

OBJECTS AND SUMMARY OF THE INVENTION

In view of avoiding this problem; in the present patent application, it is suggested as a solution that the distributor comprises ducts which pass to its side face and which open in annular grooves on the side face of the distributor. In this way it is possible to avoid torques that distort the distributor by passing the force to the side faces of the distributor. The distributor preferably comprises bores passing into a first annular groove on the side face and into a second annular groove on the side face. The first annular groove communicates with the power pressure ducts, and the second annular groove communicates with the return ducts. However, when the sense of rotation of the motor is reversed, the functions of said ducts can be changed so that the power pressure ducts become return ducts, and the return ducts become power pressure ducts. Favourably, on the distributor, on its cylindrical face, there are seals between the annular grooves. Thus, leakage through the annular grooves is prevented. The seals have been fitted favourably at the ends of annular projection edges on the side face of the distributor in separate seal cavities, which are placed on the revolving box frame. The seals are composed of annular seals.

In the following, the invention will be described with reference to some preferred embodiments of the invention illustrated in the figures in the accompanying drawings, the invention being, yet, not supposed to be confined to said embodiments alone.

FIG. 1B is an illustration of principle of the coupling and joint operation between the cam ring and the pistons.

FIG. 2 shows the area X subject of the present invention in connection with the distributor in FIG. 1A in an enlarged scale.

Figure 3A:
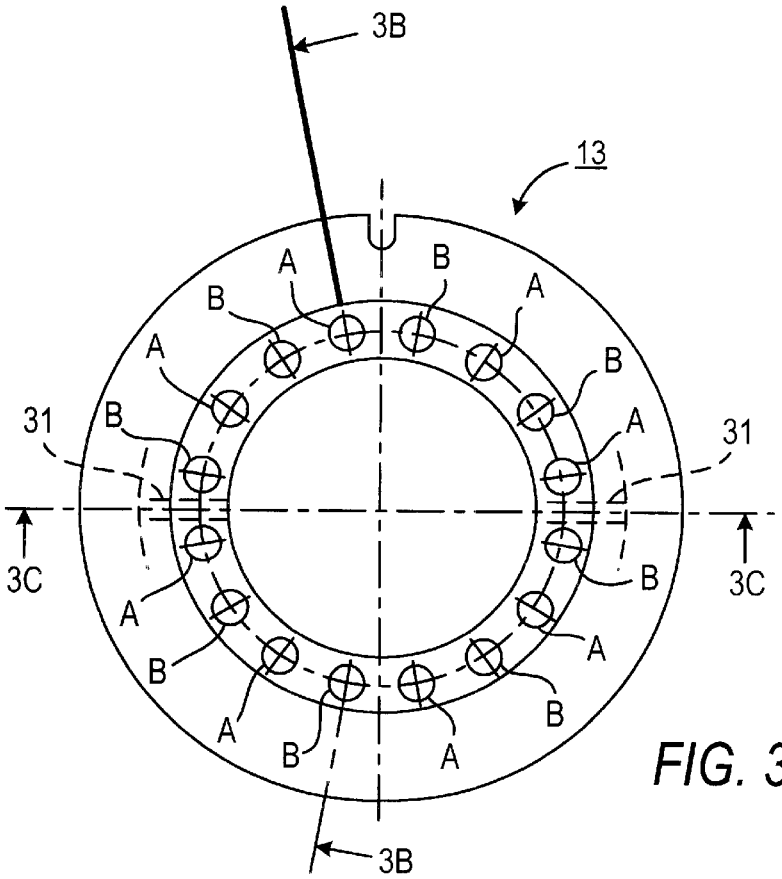
FIG. 3A shows the distributor viewed from the end.
Figure 3C:
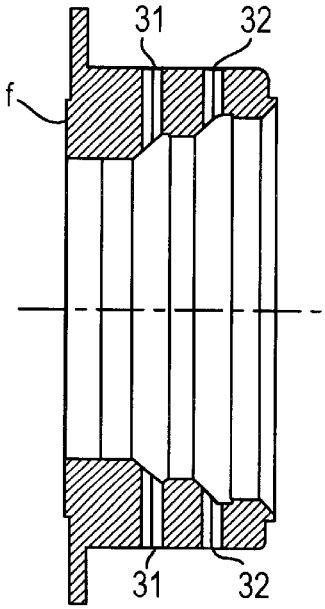
Figure 3B:
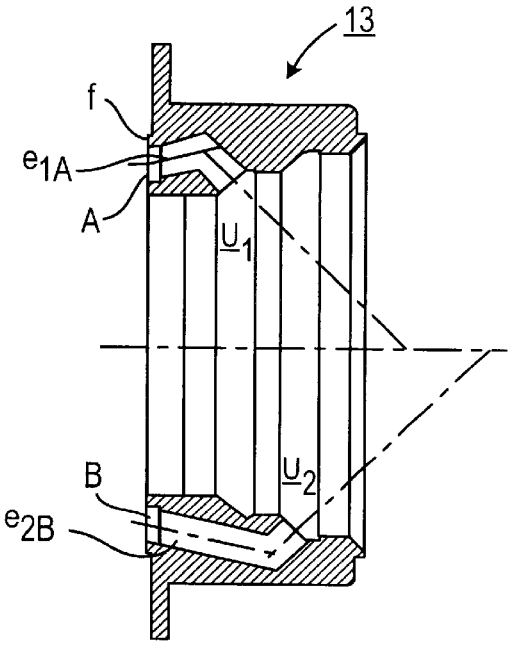

FIG. 3B is a sectional view taken along the line I—I in FIG. 3A. FIG. 3C is a sectional view taken along the line II—II in FIG. 3A. The distributor comprises separate ducts passing to the side face of the distributor.

Figure 4A:
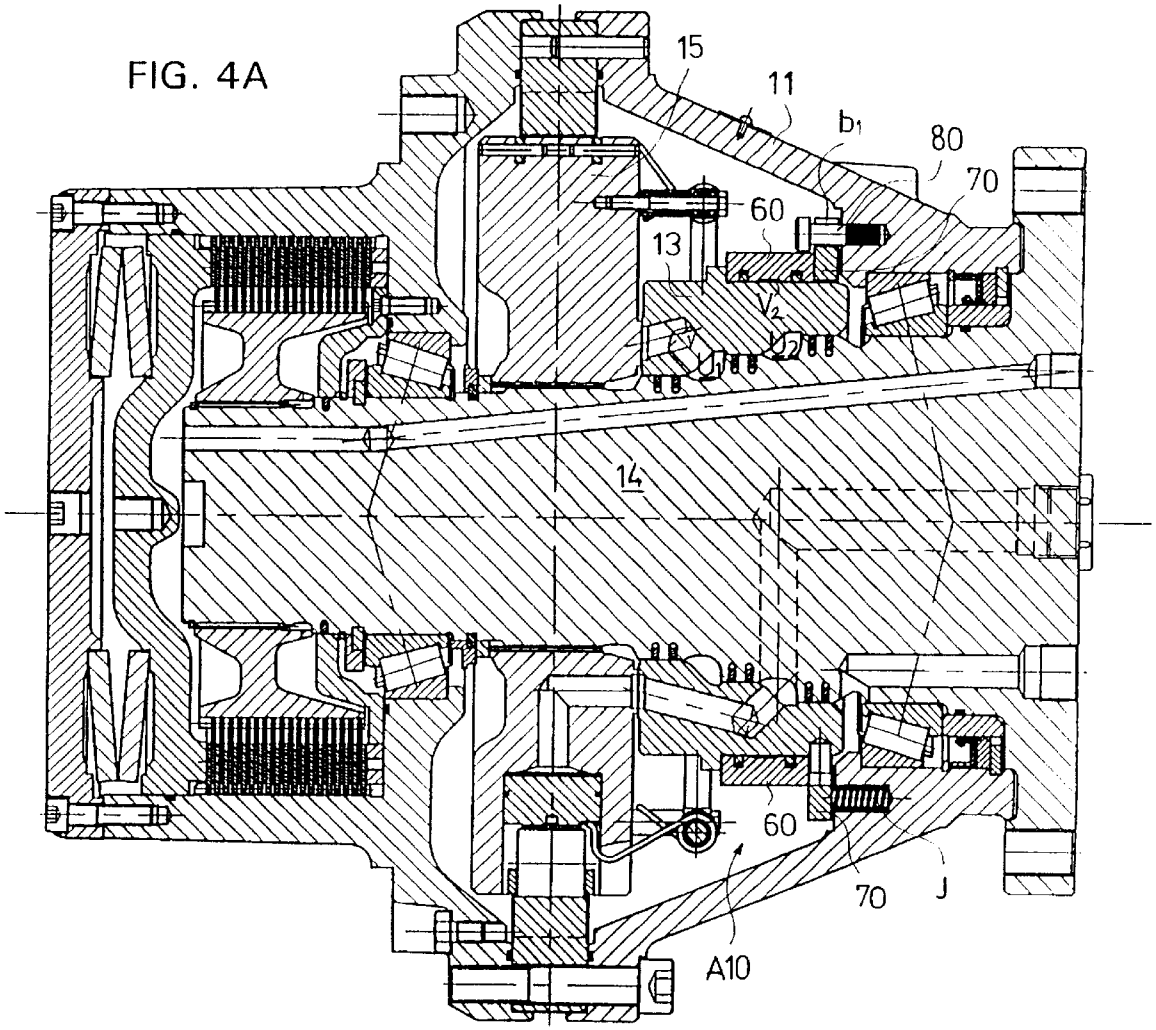

FIG. 4A shows an embodiment of the invention in which the pressure is applied to one pressure medium space $V_1$ only in connection with the side face of the distributor valve.

Figure 4B:
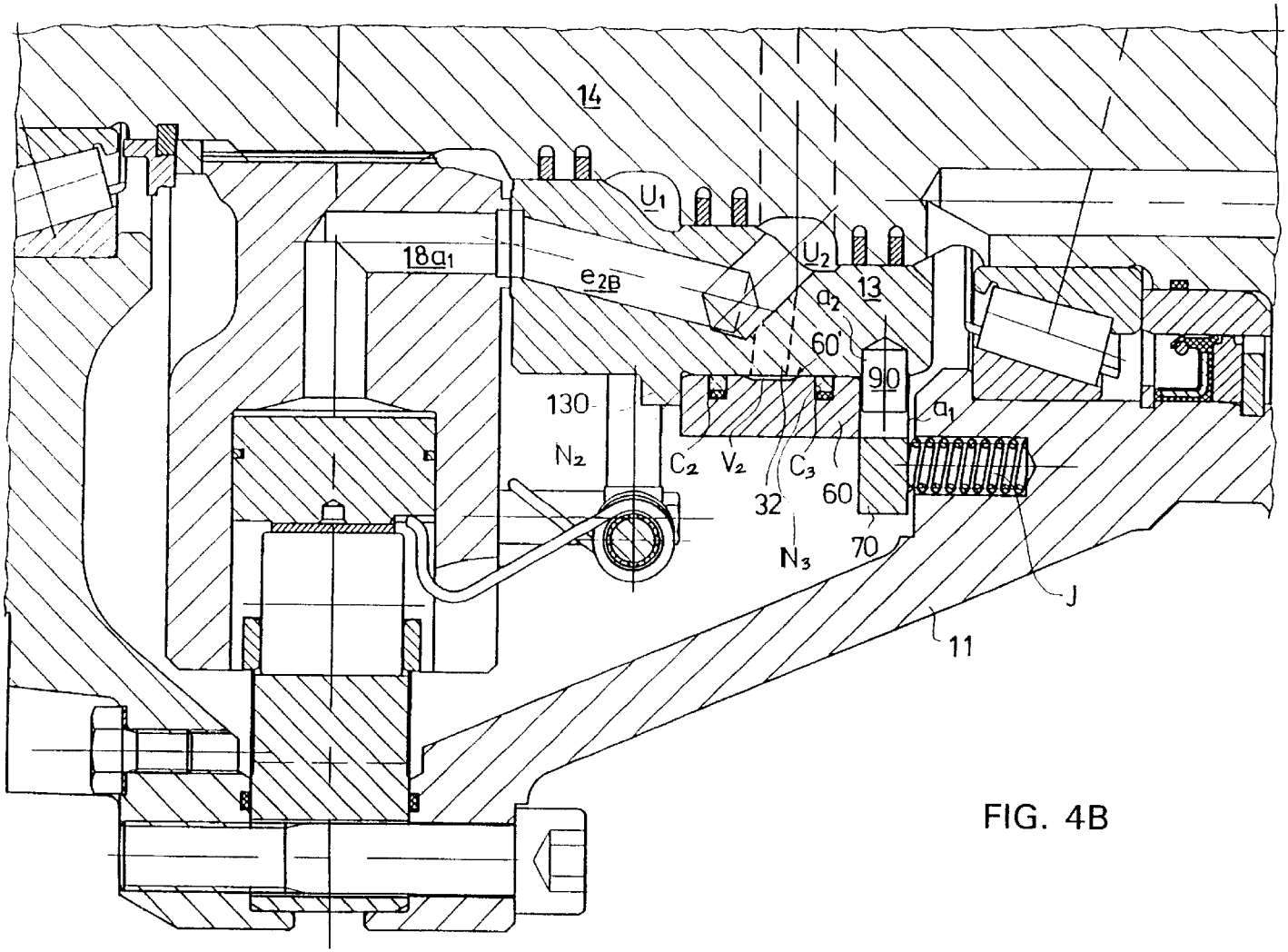

FIG. 4B shows the area $A_{10}$ out of FIG. 4A in an enlarged scale.

DETAILED DESCRIPTION OF THE INVENTION

Figure 1A:
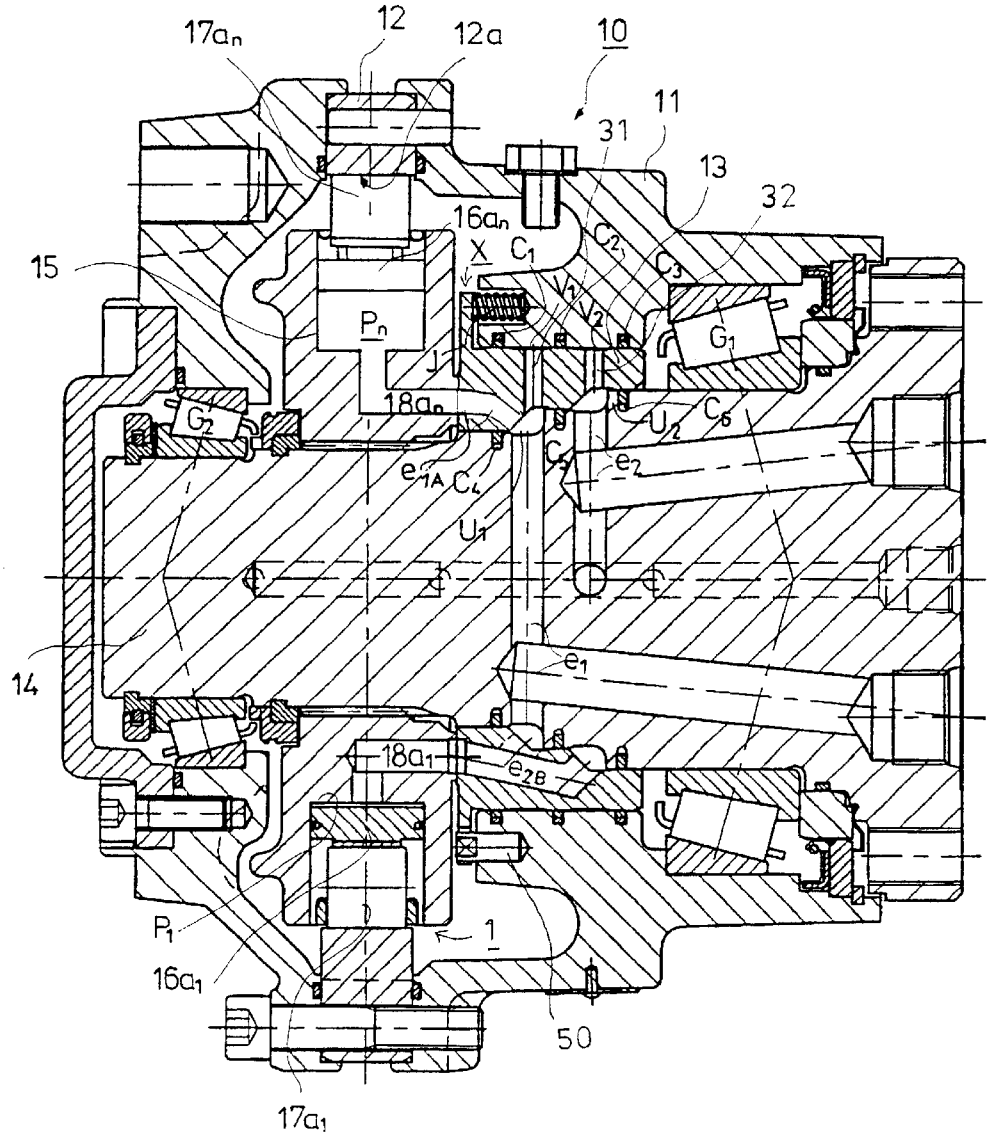
FIG. 1A is a sectional view of a radial-piston hydraulic motor in accordance with the invention.

FIG. 1A is a sectional view of a radial-piston hydraulic motor 10. FIG. 2 shows the area X subject of the present invention out of FIG. 1A in an enlarged scale. The radial-piston hydraulic motor 10 comprises a rotated box frame 11. The box frame 11 is connected with a cam ring 12. In the embodiment shown in the figure, the box frame 11 is rotated, and the box frame is connected with a distributor 13 placed in a stationary position. The distributor 13 is a distributor valve, which comprises a number of axial bores $e_{1A}$;$e_{2B}$, which communicate with the inlet duct $e_1$ and the outlet duct $e_2$ in the central shaft 14. The distributor 13 revolves along with the box frame 11, and the pressurized ducts $e_{1A}$ and the return fluid ducts $e_{2B}$ enter alternatingly into contact with the duct ends of the flow ducts 18$a_1$, 18$a_2$ . . . passing into the cylinder spaces $p_1$,$p_2$ . . . for the pistons 16$a_1$, 16$a_2$ . . . provided in the cylinder frame 15. Thus, some of the pistons 16$a_1$, 16$a_2$ . . . in the cylinders are at a power stage, in which case the pressurized medium is passed through the distributor 13 into the cylinder spaces $p_1$,$p_2$ . . . and some of the pistons 16$a_1$, 16$a_2$ . . . are at an idle stage, in which case fluid is passed out of the cylinder spaces $p_1$, $p_2$ of said pistons 16$a_1$, 16$a_2$ . . . through the distributor 13 into the outlet duct $e_2$. The non-revolving cylinder frame 15 provided on the non-revolving central shaft 14 comprises a cylinder group 1, and in the cylinder frame 15 there are a number of cylinder spaces $p_1$,$p_2$ . . . and a number of pistons 16$a_1$, 16$a_2$ . . . in said cylinder spaces. The piston 16$a_1$, 16$a_2$ . . . has been fitted to move in the piston space $p_1$,$p_2$ . . . by the effect of the fluid pressure introduced into said piston space. As is shown in the figure, each piston 16 comprises a press wheel 17$a_1$, 17$a_2$ . . . of circular section freely mounted on the top face of the piston. When the piston 16$a_1$, 16$a_2$ . . . is pressed with force against the wave-shaped face 12$a$ of the cam ring 12, the cam ring 12 and the connected box frame 11 and the distributor valve 13 connected with the box frame 11 can be made to revolve. Through the ducts 31 and 32, a pressurized medium is passed into the groove $V_1$ and $V_2$ provided on the face 13$a$ of the distributor 13. In this connection, an annular radial power effect is produced in the grooves $V_1$,$V_2$, and the distributor 13 is kept straight, and its front face f is sealed so that no lateral leakage of fluid occurs through the front face f.

The box frame 11 has been mounted to revolve on the bearings $G_1$ and $G_2$ in relation to the central shaft 14.

In the figure, a spring is denoted with the letter J. By means of the spring, the front face of the distributor valve 13 is pressed against the front face of the cylinder frame 15. The function of the spring J is, in the starting situation, to provide an initial force by whose means the dividing face between the parts 13 and 15 is kept tight. The shapes of the spaces $U_1$, $U_2$ in the pressure ducts have been chosen so that, after a pressure has been generated in the ducts, the pressure acts upon the distributor valve 13 and presses it with a force axially against the front face of the cylinder frame 15.

FIG. 1B is an illustration of principle of the interaction between the cam ring 12 and the pistons 16$a_1$, 16$a_2$. Some of the pistons 16$a_1$, 16$a_2$ are at a power pressure, and some of the pistons have been connected through the distributor 13 to the side of the lower return pressure.

As is shown in FIG. 2, the distributor 13 comprises the ducts 31 and 32. The ducts 31 communicate with the annular space $U_1$ between the central shaft 14 and the distributor 13 and with the annular groove $V_1$ on the side face of the distributor 13. Further, the inlet duct $e_1$ passes into said annular space $U_1$. The annular groove $V_1$ on the side face of the distributor has been sealed towards the sides by means of the seal $N_1$, $C_1$ and $N_2$, $C_2$. Likewise, the annular space $U_1$ between the central shaft 14 and the distributor 13 has been sealed by means of the seals $C_4$ and $C_5$ provided on the shaft. Into the annular space $U_1$, the pressurized medium, i.e. the power pressure, is passed through the duct $e_1$. Out of the annular space $U_1$, ducts $e_{1A}$ pass to the front face of the distributor and further to the pistons. The ends of the ducts $e_{1A}$ are denoted with the reference letters A in FIG. 3A. The annular seals $C_1$, $C_2$ and $C_3$ are placed in annular cavities $O_1$, $O_2$ and $O_3$ in the box frame 11. The seal rings $N_1$, $N_2$ and $N_3$ proper of the seal extend into the cavities $O_1$, $O_2$ and $O_3$. What is concerned is a seal of two parts, which consists of an O-ring $C_1$, $C_2$ and $C_3$ of rubber and of its support ring, i.e. a seal ring $N_1$, $N_2$ and $N_3$, which is favourably made of a teflon-bronze alloy.

The outlet duct $e_2$ is opened into the second annular space $U_2$ between the central shaft and the distributor, out of which space a duct 32 passes into the annular groove $V_2$ placed on the side face of the distributor. The annular groove $V_2$ has been sealed towards the sides by means of seals $N_2$, $C_2$ and $N_3$,$C_3$ passing around the distributor. Out of the annular space $U_2$, ducts $e_{2B}$ also open to the front face f of the distributor 13, and through said ducts $e_{2B}$ the fluid that is displaced by the pistons 16$a_1$, 16$a_2$ that are not at a power stage is passed first into the annular space $U_2$ and further into the return duct $e_2$. When the sense of rotation of the motor is reversed, the functions of the ducts are changed. The seals $C_4$, $C_5$ and $C_6$ are placed on the shaft 14 in its grooves $O_4$, $O_5$ and $O_6$. The seals $C_4$ and $C_5$ are placed at both sides of the annular space $U_1$, and the seals $C_5$ and $C_6$ are placed at both sides of the annular space $U_2$, so that no leakage of fluid takes place towards the sides through the boundary faces between the distributor 13 and the shaft 14.

FIG. 3A shows the distributor as viewed from ahead. FIG. 3B is a sectional view taken along the line I—I in FIG. 3A. FIG. 3C is a sectional view taken along the line II—II in FIG. 3A.

In FIG. 3A, the reference letters A denote the duct ends of the power pressure ducts $e_{1A}$ on the front face f of the distributor 13. The ducts $e_{1A}$ open at the opposite end in the annular space $U_1$ between the central shaft 14 and the distributor 13. The end openings of the return ducts $e_{2A}$ are denoted with the reference letters B. Said ducts $e_{2B}$ open in the annular space $U_2$ between the central shaft 14 and the distributor 13 and further in the return duct $e_2$.

FIG. 3B is a sectional view taken along the line I—I in FIG. 3A. As is shown in the figure, a duct $e_{1A}$ passes from the annular space $U_1$ in the distributor to the front face f of the distributor. Similarly, from the other annular space $U_2$, which has been formed between the distributor 13 and the central shaft 14, a return duct $e_{2B}$ passes to the front face f.

FIG. 3C is a sectional view taken along the line II—II in FIG. 3A. As is shown in FIG. 3C, the ducts 31 open at opposite sides of the distributor 13 on the side face 13*a* of the distributor 13 in the first annular groove $V_1$ on the side face and, similarly, from the annular space $U_2$, at opposite sides of the distributor, the ducts 32 open on the side face 13*a* of the distributor in the second annular groove $V_2$ on the side face 13*a*.

In the embodiment illustrated in the figures above, the fluid at the power pressure has been passed into a groove $V_1$, $V_2$ provided on the side face of the distributor which groove is defined both by the construction of the distributor and by the opposite backup face, which is composed of the box frame 11 in the embodiments described above. The box frame 11 has been connected with the distributor valve 13 so that the box frame 11 rotates the distributor valve 13. Said coupling has been permitted by means of cotter pins 50, which are illustrated in the figures above. Between the face $T_1$ of the box frame 11 and the face 13*a* of the distributor valve 13, there is a glide fitting. Said arrangement permits application of a backup force against the distributor by passing a pressure into the grooves $V_1$, $V_2$. The cotter pin 50 transfers the rotation torque to the distributor valve 13, in which connection the distributor valve 13 revolves while rotated by the box frame 11. The play of the cotter pin, however, permits an axial movement of the distributor valve 13, in which connection, by means of the spring force of the spring J and by means of hydraulic pressure, the distributor valve 13 can be pressed against the cylinder frame in order that a tight dividing face could be obtained.

Within the scope of the present invention, an embodiment as shown in FIGS. 4A and 4B is also possible, in which the groove $V_2$ has been formed in the same way as in the embodiments described above on the side face 13*a* of the distributor valve 13, but the backup face is the inner face 60' of a separate ring 60. The ring 60 is placed freely on the face 13*a* of the distributor valve 13 between the shoulder 130 on the distributor valve 13 and the locking ring 70. The seal construction is similar to that in the embodiments described above, and the ring 60 comprises seals $N_1$, $C_1$ and $N_2$, $C_2$ pressed against the distributor valve 13 and fitted in the grooves in the ring so as to seal the space $V_2$ towards the sides, while the space $V_2$ has, in this embodiment, been formed in the ring 60 on its inner face 60'.

In the embodiment shown in FIGS. 4A and 4B, the box frame 11 has been connected by means of cotter pins 80 with the locking ring 70, while the locking ring 70 has been connected with the distributor valve 13 by means of pins 90. The cotter pin 80 has been connected with the locking ring 70 with a loosely fitting glide fitting, in which case an axial movement between the distributor valve 13 and the connected locking ring 70 is permitted. The cotter pins 80 and 90 interconnect the parts 13, 70 and the box frame 11 so that the rotation torque is transferred to the distributor valve 13 from the box frame 11. Thus, the distributor valve 13 revolves while rotated by the box frame 11 and along with the box frame. The ring 60 is placed freely with a glide fitting on the side face 13*a* of the distributor 13. The space $V_2$ communicates with the pressurized fluid duct through the duct 32.

In order that the distributor valve 13 could revolve reliably in relation to the central shaft and in order that there should not be any resistance to rotation, the locking ring 70 must be connected with the box frame 11 so that a certain radial movement is also permitted for the locking ring in relation to the central shaft 14. Said radial movement is permitted so that a groove $a_1$ has been made into the locking ring 70, into which groove $a_1$ a pin 90 has been fitted. The pin 90 is further connected with a pin hole $a_2$ in the distributor valve 13. Thus, the locking ring 70 is kept axially in a stationary position in relation to the distributor valve 13, but a certain radial movement is permitted for the locking ring. Thus, the locking ring 70 can position itself freely in a suitable radial position. On the other hand, by means of the cotter pin 80 between the locking ring 70 and the box frame 11, an axial movement is permitted for the distributor valve 13, but the locking ring 70 and the box frame 11 are kept radially immobile in relation to one another. By means of the cotter pin 80 passed through the holes $b_1$ in the locking ring 70, the rotation drive and the torque are, however, transferred from the box frame 11 to the distributor valve 13.

In the embodiment of the invention shown in FIGS. 4A and 4B, the pressurized medium is passed into one annular space $V_2$ only, which space has been fitted in the right-side end of the distributor, as shown in the figure. In practice, it has been noticed that this part of the distributor valve 13 is less rigid, in which case the greatest advantage is obtained from the arrangement in accordance with the invention so that the pressure space $V_2$ is placed in said portion of the distributor valve 13. Thus, in the embodiment shown in FIGS. 4A and 4B, there is one groove $V_2$ only, which has been made onto the inner face 60' of the ring 60 in this embodiment, and said groove communicates with the duct 32 and further with the rest of the system of ducts in the way shown in the figures. The embodiment shown in these figures can also be such that it is fully similar to the earlier embodiments, and, thus, there are two grooves, i.e. the grooves $V_1$ and $V_2$, on the inner face 60' of the ring 60. The arrangement of supply of the pressure medium is similar to that of the earlier embodiment. FIGS. 4A and 4B, however, show a simplified embodiment, in which the supply of pressure has been arranged at the portion of the construction at which a compensation of forces is expressly needed.

What is claimed is:

1. A radial-piston hydraulic motor (10), comprising:

at least one stationary cylinder assembly (1);

a piston (16$a_1$, 16$a_2$) having a press wheel (17$a_1$, 17$a_2$ . . . ) is disposed in a cylinder space ($p_1$, $p_2$) of said assembly said piston moves radially back and forth;

a cam ring (12) having a web-shaped face (12*a*), said cylinder spaces ($p_1$, $p_2$) of said piston is structured and arranged to receive a hydraulic fluid said press wheel (17$a_1$, 17$a_2$ . . . ) of the pistons (16$a_1$, 16$a_2$ . . . ) having a power stage position wherein said press wheel is forcibly in contact with the wave-shaped face (12*a*) of the cam ring (12) and bring the cam ring (12) into a revolving movement;

a box frame (11) having a distributor valve (13) connected to the cam ring (12), said distributor valve controlling the pressurized fluid flow into the cylinder spaces ($p_1$, $p_2$ . . . ) of the pistons (16$a_1$, 16$a_2$ . . . );

a non-revolving shaft (14) having ducts ($e_1$, $e_2$) in contact with a cylinder frame(15) of said at least one cylinder groups (1);

wherein the sense of rotation of the motor can be reversed by reversing the direction of flow of the fluid through the distributor valve (13), and that the fluid is passed to the distributor valve (13) through the sets of ducts ($e_1$, $e_2$) in the shaft (14) which is placed in a stationary position together with the cylinder frame(s) (15) of at least one cylinder groups (1); and wherein the distributor (13) has a duct (31) that communicates with the power pressure and which is opened on the side face (13*a*) of the distributor (13), in which connection the force is applied, through the fluid at the power pressure, to the side face (13*a*) of the distributor (13).

2. A radial-piston hydraulic motor as claimed in claim 1, wherein said duct (31) is structured and arranged to pass the pressurized medium to the side face (13*a*) of the distributor (13), said duct (31) communicates with a groove ($V_1$) on the side face (13*a*) of the distributor (13).

3. A radial-piston hydraulic motor as in claim 2, wherein the duct (31) is positioned at one end in the groove ($V_1$) between the side face (13*a*) of the distributor (13) and the box frame (11),said duct is positioned at an opposite end of said duct (31), in an annular space ($U_1$), said annular space is between the central shaft (14) and the distributor (13) and wherein annular space ducts ($e_{1A}$) pass to the front fact (f) of the distributor, and the distributor (13), when it revolves, distributes the pressurized medium further to the pistons (16$a_1$, 16$a_2$ . . . ) at the power stage.

4. A radial-piston hydraulic motor as in claim 2, wherein the groove ($V_1$) forms a seal, the groove has been sealed towards the sides by O-ring seals ($C_1$, $C_2$) and by seal rings ($N_1$ and $N_2$), which have been fitted into seal cavities ($O_1$, $O_2$) in the box frame (11).

5. A radial-piston hydraulic motor as claimed in claim 1, further comprising a second duct (32), said second duct communicates with the return fluid flow coming from the pistons (16$a_1$, 16$a_2$ . . . ).

6. A distributor as claimed in claim 5, wherein the second duct (32) is opened into the annular groove ($V_2$) on the side face (13*a*) of the distributor (13) and, from the opposite end of said second duct, in the annular space ($U_2$) between the central shaft (14) and the distributor (13), wherein annular space ($U_2$) ducts ($e_{2B}$) pass to the front face (f) of the distributor and into the outlet duct ($e_2$), and that the annular groove ($V_2$) has been sealed towards the sides by O-ring seals ($C_2$ and $C_3$) and seal rings ($N_2$ and $N_3$), which have been fitted into the seal cavities ($O_2$, $O_3$) in the box frame (11).

7. A radial-piston hydraulic motor as claimed in claim 1, wherein when the sense of rotation of the hydraulic motor is reversed, the pressurized medium is passed into the duct ($e_2$) and further into the annular space ($U_2$) and further through said space into the second annular groove ($V_2$) provided on the side face (13*a*) of the distributor (13) and to the front face (f) of the distributor, and similarly, the return flow from the pistons (16$_{a1}$, 16$_{a2}$ . . . ) is passed through the ducts ($e_{1A}$) into the annular space ($U_1$) between the distributor and the shaft and further, through said space, into the return duct ($e_1$), in which connection the functions of the sets of ducts have been reversed in respect of the power pressure and the return pressure, as compared with the reversed drive of sense of rotation.

8. A radial-piston hydraulic motor as claimed in claim 1, wherein the radial-piston hydraulic motor comprises seals ($C_4$,$C_5$ and $C_6$) in connection with the annular spaces ($U_1$ and $U_2$) placed between the distributor (13) and the shaft (14), in which connection, at both sides of the annular space ($U_1$), there are the seals ($C_4$ and $C_5$), and at both sides of the annular space ($U_2$), there are the seals ($C_5$ and $C_6$) in which way leakage through the boundary face between the central shaft (14) and the distributor (13) is prevented.

9. A radial-piston hydraulic motor as claimed in claim 1, wherein the pressurized medium is passed into a space ($V_2$), placed between the side face (13*a*) of the distributor (13) and a separate ring (60) fitted around the distributor (13).

10. A radial-piston hydraulic motor as claimed in claim 9, wherein the groove ($V_2$) has been formed on the inner face (60') of the ring (60), and that the groove ($V_2$) has been sealed at both sides by means of seals ($N_2$, $C_2$, $N_3$, $C_3$).

11. A radial-piston hydraulic motor as claimed in claim 10, wherein the ring (60) has been fitted between a shoulder (130) on the side face of the distributor valve (13) and a locking ring (70) connected with the distributor valve (13), and that the locking ring (70) has been coupled with the box frame (11) of the radial-piston hydraulic motor (10) by means of cotter pins (80) so that the locking ring is mobile in the axial direction but has no play in the direction of rotation, in which case, by means of the cotter pins (80), the movement of rotation of the box frame (11) is transferred to the locking ring (70) and further, through the ring, to the distributor valve (13), in which connection the distributor valve (13) is rotated through the box frame (11) along with the box frame, and in which construction an axial movement of the distributor valve (13) is, however, permitted while a spring (J) presses the front face of the distributor valve (13) tightly against the front face of the cylinder frame (15).

12. A radial-piston hydraulic motor comprising:

a box frame;

at least one cylinder;

a cam ring operably coupled to said box frame;

at least one piston adapted for traveling within said cylinder, said piston having a power stage position wherein said piston is placed into contact with said cam ring to thereby rotate said cam ring;

a stationary central shaft having at least one duct for delivering a flow of hydraulic liquid to said cylinder for driving said piston;

a distributor valve for controlling a flow of said hydraulic fluid into said cylinder, wherein said distributor valve includes a first duct which communicates with said at least one duct in said central shaft and a first groove arranged within a side face of the distributor valve body which communicates with said first duct.

13. A radial-piston hydraulic motor according to claim 12, wherein said first duct includes a first end which communicates with said groove and a second end which communicates with an annular space which communicates with said duct in said central shaft.

14. A radial-piston hydraulic motor according to claim 12, further comprising O-ring seals and seal rings structured and arranged to seal said first groove against leakage.

15. A radial-piston hydraulic motor according to claim 12, wherein said distributor valve further comprises a second groove arranged within a side face of the distributor valve and a second duct in communication with said second groove, said second groove and said second duct adapted for delivering a return flow of hydraulic fluid out of said cylinder.

16. A radial-piston hydraulic motor according to claim 15, wherein said first duct includes a first end which communicates with said second groove and a second end which communicates with an annular space which communicates with said duct in said central shaft.

17. A radial-piston hydraulic motor according to claim 15, further comprising O-ring seals and seal rings structured and arranged to seal said second groove against leakage.

* * * * *